US005178390A

United States Patent [19]

Okada

[11] Patent Number: 5,178,390

[45] Date of Patent: Jan. 12, 1993

[54] GAME MACHINE

[75] Inventor: Kazuo Okada, Tokyo, Japan

[73] Assignee: Kabushiki Kaisha Universal, Oyama, Japan

[21] Appl. No.: 826,823

[22] Filed: Jan. 28, 1992

[30] Foreign Application Priority Data

Jan. 28, 1991 [JP] Japan ..... 3-26853

[51] Int. Cl.[5] ..... A63F 5/04; G07F 17/34

[52] U.S. Cl. ..... 273/143 R

[58] Field of Search ..... 273/143 R, 138 A

[56] References Cited

U.S. PATENT DOCUMENTS 4,889,334 12/1989 Okada ..... 273/143 R

FOREIGN PATENT DOCUMENTS 2170938 8/1986 United Kingdom ..... 273/143 R 2191030 12/1987 United Kingdom ..... 273/143 R

*Primary Examiner*—Benjamin H. Layno

*Attorney, Agent, or Firm*—Young & Thompson

[57] ABSTRACT

A slot machine wherein a predetermined insurance premium value is set for example by inserting a predetermined number of coins besides a value, e.g. a number of coins, to be bet on each game prior to starting a game, thereby to start an insurance period. During the insurance period, the values having been bet on games are summed. When the sum reaches a predetermined amount, a predetermined value of insurance is paid out, whereupon the insurance period is terminated. Also when a big hit occurs, the insurance period is terminated. A display displays the values having been bet on games played in the insurance period. The number of games may be used instead of the total values that have been bet on the games.

15 Claims, 4 Drawing Sheets

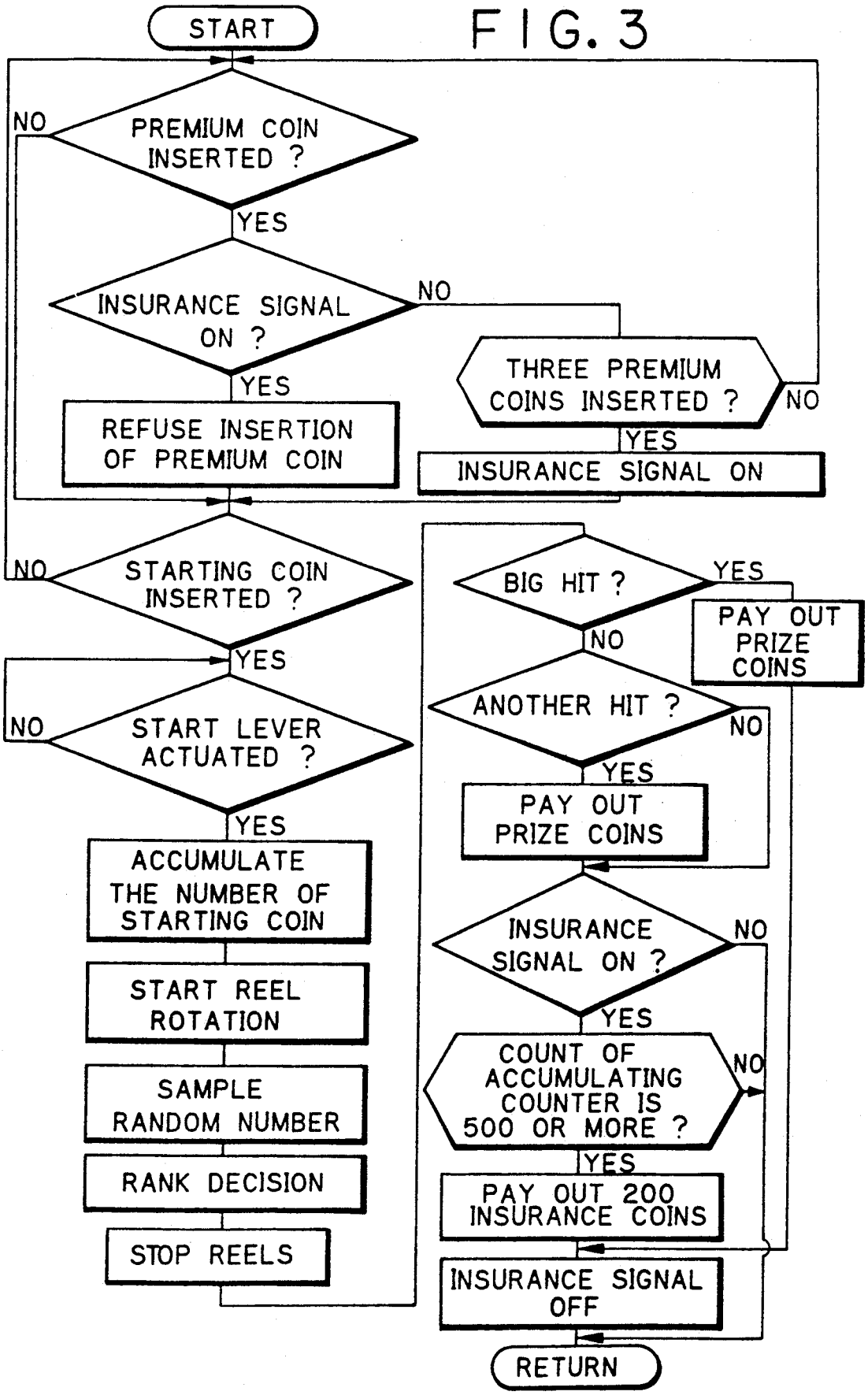
FIG. 3
START
PREMIUM COIN INSERTED ?
NO
YES
INSURANCE SIGNAL ON ?
NO
YES
REFUSE INSERTION OF PREMIUM COIN
THREE PREMIUM COINS INSERTED ?
NO
YES
INSURANCE SIGNAL ON
STARTING COIN INSERTED ?
NO
YES
START LEVER ACTUATED ?
NO
YES
ACCUMULATE THE NUMBER OF STARTING COIN
START REEL ROTATION
SAMPLE RANDOM NUMBER
RANK DECISION
STOP REELS
BIG HIT ?
YES
PAY OUT PRIZE COINS
NO
ANOTHER HIT ?
NO
YES
PAY OUT PRIZE COINS
INSURANCE SIGNAL ON ?
NO
YES
COUNT OF ACCUMULATING COUNTER IS 500 OR MORE ?
NO
YES
PAY OUT 200 INSURANCE COINS
INSURANCE SIGNAL OFF
RETURN

GAME MACHINE

BACKGROUND OF THE INVENTION

1. Field of the Invention

The present invention relates to a game machine, and more particularly to a slot machine in which a player can play a game by inserting coins (including medals and tokens) or by using a memory card.

2. Prior Art

In a slot machine, a game is generally started upon actuation of a start lever after insertion of one, two or three coins in the slot machine. Then, a plurality of reels with symbols arranged thereon simultaneously start rotating. The reels are thereafter caused to stop rotating at random or in response to the depression of a stop button or stop buttons. Whether a prize should be awarded, and if so what prize, is determined based on the combination of symbols that are finally placed on a predetermined number of winning lines when the reels stop after rotating. If the game results in a win, a predetermined number of coins, according to the rank of the win, e.g. a big hit, medium hit, small hit or the like, is paid out.

Furthermore, as is mentioned above, there have also been slot machines wherein a specific game card is used instead of coins, which is usable exclusively in playing the slot machine game. The game card has an IC memory or an LSI memory for recording data or is capable of magnetically recording data thereon. Prior to starting a game, an appropriate value is selectable to be bet on the game within an available value, that is, the value currently recorded on the game card. If the game results in a win, a predetermined value to be paid out is recorded on the game card, as an addition to the available value. If the game results in a loss, the value having been bet is deducted from the available value.

Independently of whether the reels of the slot machine are controlled to stop in response to the depression of the stop buttons, or the reels are automatically caused to stop at random, the probability of obtaining hits is previously set so that the pay-out rate of the slot machine, that is, the ratio of the total paid out value to the total bet value, approaches a predetermined figure the greater the number of games that are played. Especially, the probability of obtaining a big hit, for which a high value is paid out, is ordinarily set at about 1% of the total number of games, considering such a predetermined pay-out rate. It is to be noted that the big hit includes not only a hit for which at once a high value is paid out, but also a hit from which it becomes possible to play a number of privileged or bonus games in which the probability of obtaining hits is exceptionally high.

In the same way as for the big hit, the probabilities of obtaining medium and small hits are previously set considering the predetermined pay-out rate. Therefore, but for a big hit, the player would probably lose the available value during a number of played games, even if a number of medium and/or small hits are obtained in the meantime.

However, big hits do not occur with regular frequency, but only with a certain probability, so that it is in practice possible that two out of 100 games may result in big hits, or on the other hand not one of 200–300 games may result in a big hit. Therefore, the player might lose interest in the games if the player cannot win a big hit even after playing many games and so is steadily falling behind.

OBJECT OF THE INVENTION

It is, therefore, an object of the present invention to provide a game machine which can hold the player's interest in the game even when the bet value has totalled a large sum.

SUMMARY OF THE INVENTION

To achieve the above and other objects, the present invention provides a game machine, especially a slot machine wherein a value is bet on a game and a prize is awarded for a hit obtained, and wherein an insurance premium value is set in addition to the value to be bet on each game so as to generate an insurance signal for effecting an insurance period. While the insurance signal is maintained, the values having been bet on games are accumulated. When the accumulated value reaches a predetermined amount, a predetermined value of insurance is paid out and, at the same time, the insurance signal is terminated. The insurance signal may be terminated if a big hit occurs.

By indicating that the insurance signal is maintained, and by displaying the value having been bet during the insurance period, the player can consider or expect the payment of insurance when playing games, in addition to the winning of prizes.

In the case of a slot machine wherein the value to be bet on each game is predetermined at a constant amount, it is possible to count the number of games that are played during the insurance period, so as to pay out an insured amount when the number of games reaches a predetermined number.

According to the present invention, even if the player loses many games and thus obtains a lesser prize, the player may be compensated for a part of the loss by receiving the insurance. Therefore, an unskilled player can enjoy the games without anxiety about losing a large amount of money.

BRIEF DESCRIPTION OF THE DRAWINGS

The above and other objects and advantages will become apparent from the following description of preferred embodiments with reference to the accompanying drawings wherein:

FIG. 3 is a flow chart illustrating the basic operation of the slot machine.

DETAILED DESCRIPTION OF THE PREFERRED EMBODIMENTS

Figure 1:
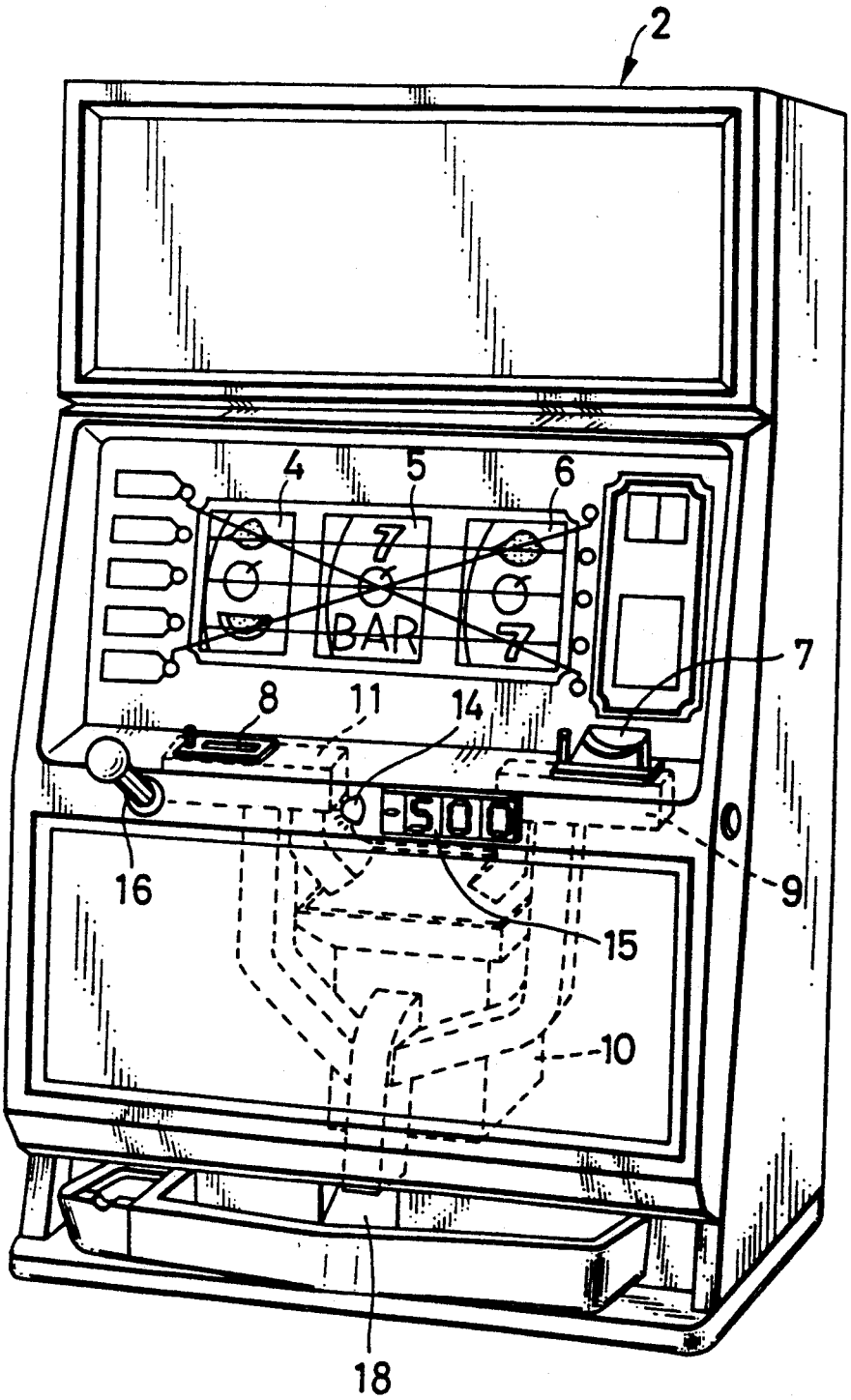
FIG. 1 is a front perspective view of a slot machine embodying the present invention.

Referring to FIG. 1 showing a front perspective view of a slot machine embodying the present invention, the slot machine 2 is provided with a front panel with three display windows, through which first, second and third reels 4 to 6 can be viewed. There are two coin slots 7 and 8 on the front panel, and the player can insert an appropriate number of coins into these coin slots 7 and 8. The first coin slot 7 is for use of inserting one to three coins prior to the start of a game. The number of coins inserted into the first coin slot 7 decides the value bet on the game, as well as the number of winning lines which are to be effective in judging a win. The starting coins that are inserted into the first coin slot 7 are sent to a hopper 10 through a detecting unit 9 including a coin discriminator and a coin detector.

The second coin slot 8 is for use of inserting a predetermined number of coins, e.g. three coins, as an insurance premium. The premium coins may optionally be inserted prior to the starting coins, so as to effect an insurance function of the slot machine. Once the three premium coins are inserted and thus the insurance function is effective, the number of starting coins inserted for subsequent games is accumulated. When the total number of inserted starting coins thus accumulated reaches a predetermined value, e.g. 500, a predetermined number of coins, e.g. 200 coins are paid out as insurance coins. However if the player does not wish to use the insurance function, it is possible to start playing by inserting only a number of starting coins without insertion of the premium coins. The premium coins inserted into the second coin slot 8 are also sent to the hopper 10 through a second detecting unit 11 including a coin discriminator and a coin detector.

An indication lamp 14 is provided for indicating that the insurance function has become effective in response to the insertion of three premium coins. An LED display 15 is provided for digitally displaying the momentary total number of starting coins that have been inserted during the insurance period. Because 200 coins are paid out as an insured amount when the cumulative number of starting coins reaches 500 during the insurance period, and the momentary total number of starting coins is displayed on the LED display 15, the player knows when to expect the insurance coins, and this expectation is in addition to the player's interest in winning prizes when playing games.

Upon actuation of a start lever 16 after the insertion of starting coins, the reels 4 to 6 simultaneously start rotating and thereafter automatically stop at random. When all the reels have stopped, it is determined which combination of symbols stops on each of the effective lines. Depending on the combination of symbols, it is determined whether the game results in a hit game or a lost game. The reels 4 to 6 are driven by respective stepping motors such that the stopped positions of the reels are electrically controlled. Namely, a random number is sampled upon actuation of the start lever 16, and the rank of hit, inclusive of a lost game, is determined according to the sampled random number. Thereafter, the reels 4 to 6 are controlled to stop correspondingly to the rank of hit determined to be displayed. When a hit is obtained, or when the insured amount is to be paid out, the hopper 10 is activated to eject coins into a saucer through an outlet 18.

Figure 2:
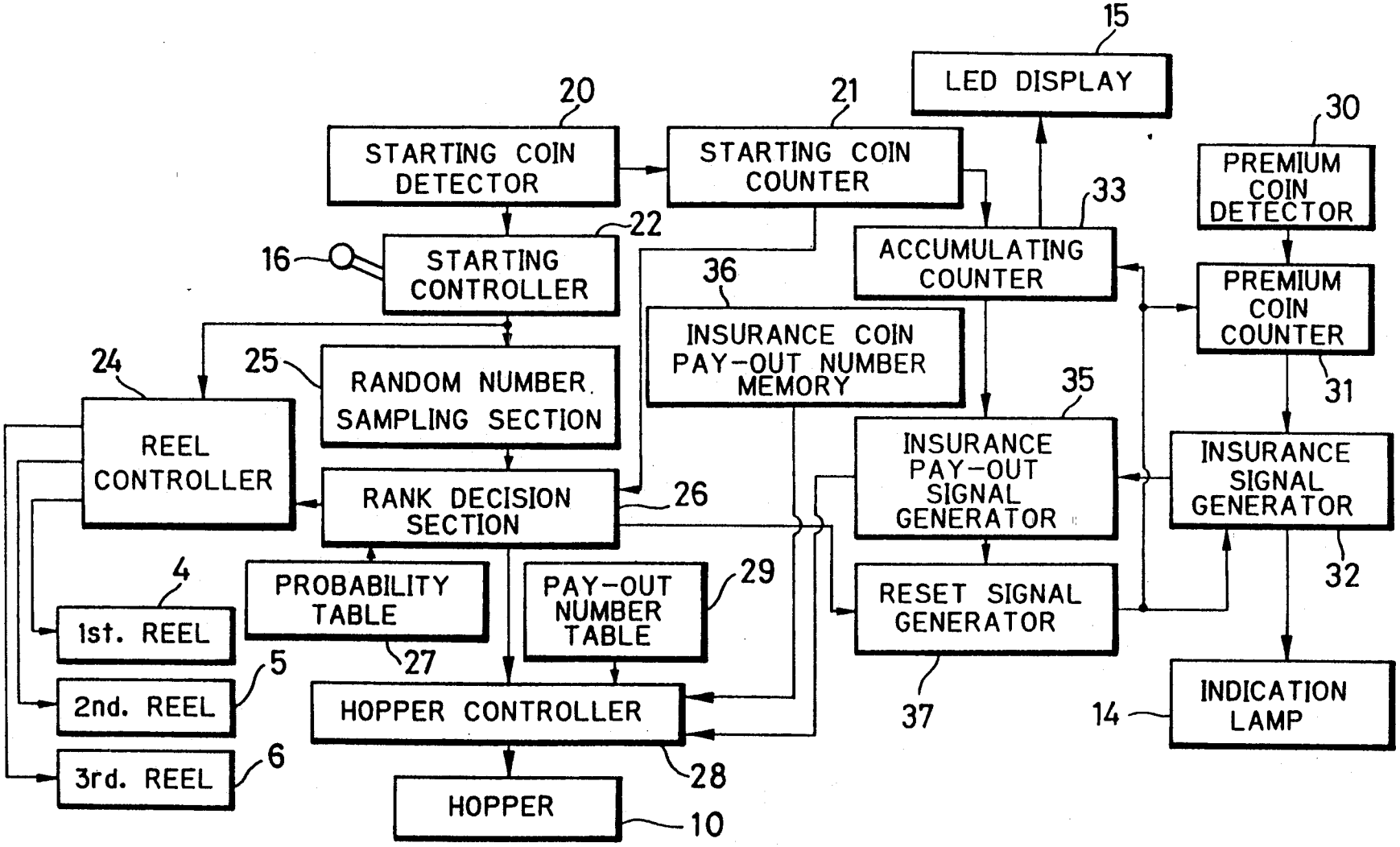
FIG. 2 is a functional block diagram of the slot machine.

In FIG. 2 showing a functional block diagram of the above-described slot machine, a starting coin detector 20 detects the starting coins inserted into the first coin slot 7. Each time a starting coin is inserted, the starting coin detector 20 outputs a detection signal. The detection signal, e.g. a pulse signal, is counted by a starting coin counter 21. Depending on the count of the counter 21, the number of effective winning lines is determined. A game starting controller 22 receives the detection signal from the starting coin detector 20, and thereafter when the start lever 16 is actuated, outputs a start signal to a reel controller 24 and a random number sampling section 25. Upon receipt of the start signal, the reel controller 24 simultaneously derives the stepping motors so as to cause the first to third reels 4 to 6 to rotate simultaneously, whereas the random number sampling section 25 samples a random number within a predetermined range of random number sequence, and outputs the random number to a rank decision section 26.

The rank decision section 26 decides the rank of hit to be displayed, inclusive of a lost game, depending on the random number sampled by the random number sampling section 25, with reference to a probability table 27. The probability table 27 stores data about all the available random numbers which are classified into big hit, medium hit, small hit and lost game groups. The rank decision section 26 determines the group to which the sampled random number belongs. Rank decision data determined in this way are sent to the reel controller 24, which then controls the reels 4 to 6 to stop in positions wherein a symbol combination corresponding to the decided rank is displayed on the effective winning line. The rank decision data are also sent to a hopper controller 28. The hopper controller 28 refers the rank decision data to a pay out number table 29 wherein the number of coins to be awarded for the respective ranks, exclusive of a lost game, are stored, so that the hopper controller 28 controls the hopper 10 to pay out a number of coins predetermined for the obtained hit.

A premium coin detector 30 detects the premium coins inserted into the second coin slot 8. Each time a premium coin is inserted, the premium coin detector 30 outputs a detection signal, which is counted by a premium coin counter 31. An insurance signal generator 32 monitor the premium coin counter 31, and outputs an insurance signal when the count of the premium coin counter 31 reaches three. Upon the insurance signal, the insurance period is started and, at the same time, the indication lamp 14 is turned on. While the insurance signal is generated, if any coins are inserted into the second slot 8, the coins are ejected through the outlet 18 as unnecessary coins.

The count of the starting coin counter 21 is cleared to zero after each game. However, during the insurance period, the count of the starting coin counter 21 is supplied to an accumulating counter 33 upon each actuation of the start lever 16. That is, the accumulating counter 33 counts the number of starting coins having been inserted during the insurance period, that is, when the accumulating counter 33 receives the insurance signal from the insurance signal generator 32. The count of the accumulating counter 33 is displayed on the LED display 15. An insurance pay-out signal generator 35 outputs an insurance pay-out signal to the hopper controller 28 when the count of the accumulating counter 33 reaches 500. Upon the insurance pay-out signal, the hopper controller 28 is activated to cause the hopper 10 to pay out 200 coins as the insured amount. The insured amount is previously memorized in an insurance coin number memory 36.

The insurance pay-out signal is supplied also to a reset signal generator 37, which then outputs a reset signal to the insurance signal generator 32, the accumulating counter 33 and the premium coin counter 31, so as to terminate the insurance signal as well as to clear the count of the counters 31 and 33 to zero. The reset signal generator 37 is adapted to receive a big hit signal from the rank decision section 26, so that the reset signal is generated also when a big hit game is obtained.

The operation of the above-described embodiment will now be described with reference to the flow chart of FIG. 3.

When playing games with the insurance function, three premium coins are inserted into the second coin slot 8. When the premium coin counter 31 counts up to three, and thus detects the insertion of the three premium coins, the insurance signal generator 32 generates an insurance signal. Then, the indication lamp 14 is turned on to indicate that the insurance function is effective. Thereafter, one to three coins are inserted into the first coin slot 7 as starting coins for the initial game in the insurance period. When the start lever 16 is actuated, the game is started in an ordinary manner. The number of starting coins is sent to the accumulating counter 33 through the starting coin counter 21.

A number of games are repeated during the insurance period, and starting coins having been inserted for the respective games are consumed. When a medium or small hit is obtained in the meantime, a number of coins are paid out corresponding to the rank of obtained hit. For example, fifteen or five coins are paid out for a medium or small hit, respectively. If the total number of coins inserted as starting coins reaches 500 before a big hit is obtained, the insurance pay-out signal generator 35 is activated to pay out 200 insurance coins, and thus the insurance period is terminated.

In this embodiment, the coins paid out for the hits have no bearing on the insurance function, except for the big hit. That is, if a big hit is obtained during the insurance period, the insurance signal is turned off by a big hit signal from the rank decision section 26, thereby terminating the insurance period. In this case, the player loses the three premium coins, that have been inserted needlessly, but instead a predetermined large number of coins are paid out for the big hit, so that most players would certainly be satisfied with the result. Of course, it would be preferable for the player to obtain a bit hit without inserting the premium coins. Therefore, the players have their choice of using or not using the insurance function.

If any premium coins are inserted into the second slot 8 during the insurance period, these coins are adapted to be ejected in the present embodiment. However, it is possible to start a new insurance period when three premium coins are inserted before the end of the insurance period already in effect.

The number of premium coins to be inserted to effect the insurance function, or the number of insurance coins to be paid out as an insured amount, may be appropriate numbers other than the above-mentioned numbers. It is also possible to determine the number of insurance coins depending on the number of premium coins inserted. In the case of a slot machine wherein several kinds of coins having different values are usable, the different values of the coins inserted may be summed as bet values, so that a corresponding number of coins are paid out when the total bet value reaches a predetermined amount. The count of the accumulating counter 33 may be reduced by the number of coins paid out for medium hits and/or small hits during an insurance period.

Although the above description relates to the embodiment adapted to a coin-operated slot machine as shown in FIG. 2, the present invention may be adapted to slot machines operable by game cards as described above. In this type of slot machine, the values bet on the respective games are summed during the insurance period. When the sum reaches a predetermined value, an insurance pay-out signal is generated, so as to record a predetermined insurance value on the game cards, in addition to the value already recorded. It may be possible to clear the sum of the bet value when the game card is changed, that is, when a player changes to another. The game card may be a prepaid card or a credit card.

Figure 4:
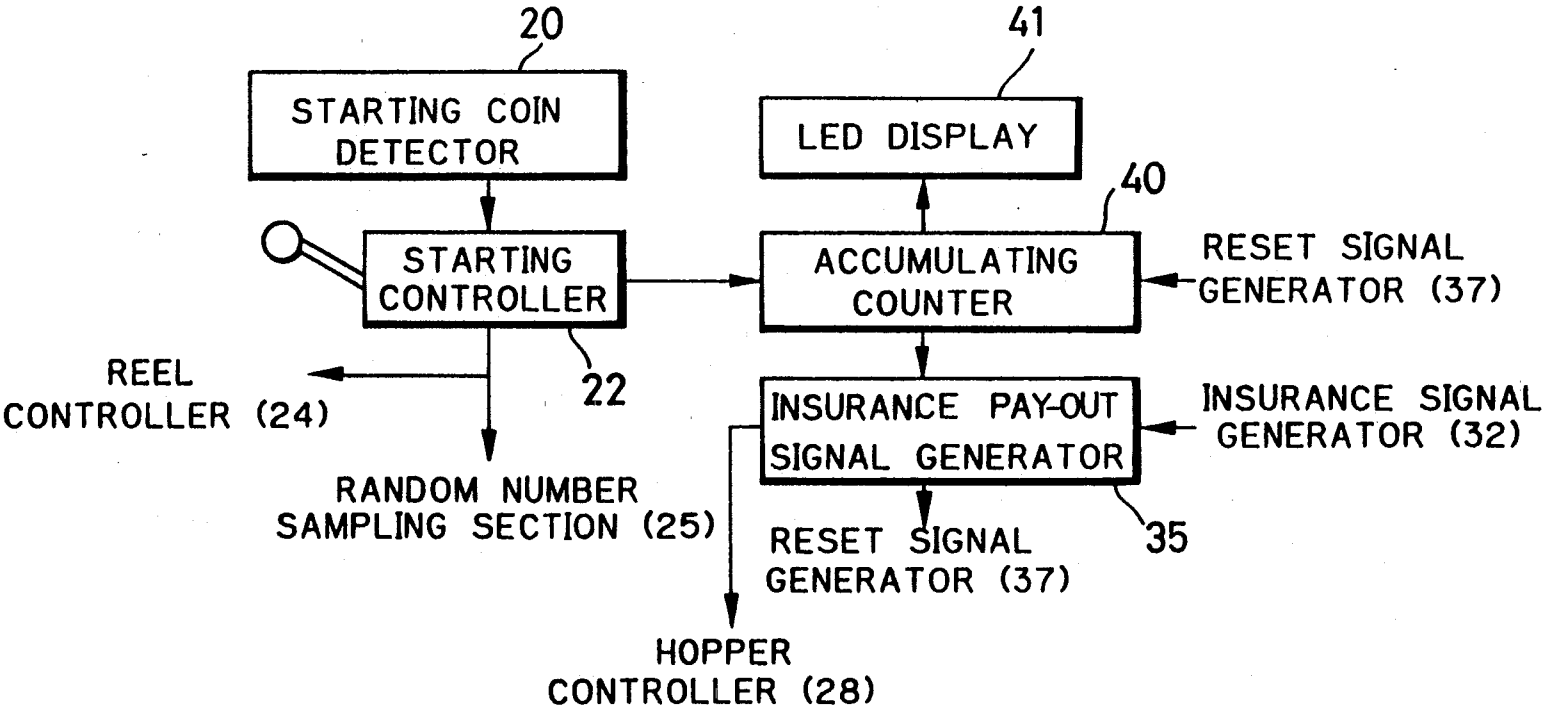
FIG. 4 is a functional block diagram according to another embodiment of the present invention.

When adapting the present invention to a slot machine wherein the value to be bet on a game must be a predetermined constant value, it is possible to count the number of games that are played during the insurance period, instead of summing the values bet on these games. In this case, an insurance pay-out signal may be generated when the number of games having been played reaches a predetermined value. FIG. 4 shows a partial function block diagram of such an embodiment wherein the number of games is counted during the insurance period. As shown in FIG. 4, an accumulating counter 40 receives the start signal from the game start controller 22 during the insurance period, and the count of the accumulating counter 40 is sent to the insurance pay-out signal generator 35 and to an LED display 41 for displaying the number of games. In this alternative, the accumulating counter 33 for accumulating the count of the starting coin counter 21 of FIG. 2 is omitted, but other constructions may be similar to those shown in FIG. 2, and hence are not illustrated.

The present invention may be adapted to a video-type slot machine wherein the symbols are displayed on a CRT screen. Thus, the present invention is not limited to these embodiments, but rather various modifications within the spirit and scope of appended claims will be apparent to people skilled in the art.

What is claimed is:

1. A game machine comprising means to bet on a game before starting the game, and means to award a first predetermined value as a prize for a hit game, said game machine further comprising:

a first signal generator for generating a first signal based on a premium which is in addition to the bet on each game;

means for selectively setting said premium at the option of the player;

accumulating means for accumulating bets on games in response to said first signal;

a second signal generator for generating a second signal when the value accumulated in said accumulating means reaches a second predetermined value;

means for awarding to the player a third predetermined value as insurance in response to said second signal; and resetting means for clearing and inactivating said accumulating means in response to said second signal.

2. A game machine as recited in claim 1, further comprising a third signal generator for generating a third signal when a predetermined size of hit occurs, said third signal causing said resetting means to clear and inactivate said accumulating means.

3. A game machine as recited in claim 2, wherein said predetermined size of hit is a big hit for which a large value is awarded as a prize.

4. A game machine as recited in claim 1, further comprising display means for displaying the values accumulated in said accumulating means.

5. A game machine as recited in claim 1, further comprising indicating means for indicating that said accumulating means is activated.

6. A game machine as recited in claim 1, wherein said bet on games and said premium are deducted from a value recorded on a memory card that may be inserted by a player into said game machine, while values awarded as prizes and insurance are added to the value recorded on said memory card.

7. A game machine as recited in claim 1, wherein said bet, said premium, said hit, and said insurance correspond to respective numbers of coins.

8. A game machine as recited in claim 7, further comprising display means which displays a number of coins in digital fashion as the value accumulated in said accumulating means.

9. A game machine comprising means to bet on a game before starting the game, and means to award a first predetermined value as a prize for a hit game, said game machine further comprising:

a first signal generator for generating a first signal based on a premium which is in addition to the bet on each game;

means for selectively setting said premium at the option of the player, without influencing said prize awarding means;

accumulating means for accumulating the number of games played in response to said first signal;

a second signal generator for generating a second signal when the number accumulated in said accumulating means reaches a second predetermined value;

means for awarding to the player a third predetermined value as insurance in response to said second signal; and resetting means for clearing and inactivating said accumulating means in response to said second signal.

10. A game machine as recited in claim 9, further comprising a third signal generator for generating a third signal and for emitting said third signal to said resetting means when a predetermined size of hit occurs, said third signal also clearing and inactivating said resetting means.

11. A game machine as recited in claim 9, further comprising display means for displaying the values accumulated in said accumulating means.

12. A game machine as recited in claim 9, wherein said bet on games and said premium are deducted from a value recorded on a memory card that may be inserted by a player into said game machine, while values awarded as prizes and insurance are added to the value recorded on said memory card.

13. A coin-operated game machine comprising means for inserting a number of coins as a bet into the machine before starting a game, and means for awarding a predetermined number of coins as a prize for a hit game, said coin-operated game machine further comprising:

a first coin counter for counting the number of coins bet on each game;

means for inserting in the machine separately from said bet coins and at the option of the player, a number of coins as an insurance premium;

a second coin counter for counting said insurance premium coins, said second coin counter being cleared each time the count thereof reaches a first predetermined number;

a third coin counter for counting the total number of coins counted by said first coin counter, said third coin counter being activated to start counting when said second coin counter has counted said first predetermined number, and said third coin counter being cleared when having counted a second predetermined number; and pay-out means to pay out a third predetermined number of coins when said third coin counter has counted said second predetermined number.

14. A coin-operated game machine as recited in claim 13, wherein said third coin counter is cleared when a predetermined hit occurs for which a large number of coins are to be paid out.

15. A game machine comprising means to bet on a game before starting the game, and means to award a predetermined value as a prize for a hit game, said game machine further comprising:

a first signal generator for generating an insurance signal based on a predetermined insurance premium which is in addition to the bet on the game;

means for selectively setting said insurance premium at the option of the player;

accumulating means for accumulating bets on games during a period of duration of said insurance signal;

a second signal generating means for generating an insurance pay-out signal upon detecting that the accumulated bets in said accumulating means total a predetermined amount, so as to pay out a predetermined value of insurance; and resetting means for clearing said accumulated amount from said accumulating means and terminating said insurance signal in response to said insurance pay-out signal.

* * * * *